US006675440B1

(12) United States Patent
Lautenschläger

(10) Patent No.: US 6,675,440 B1
(45) Date of Patent: Jan. 13, 2004

(54) MOUNTING PLATE FOR FURNITURE HINGES

(75) Inventor: Gerhard Wilhelm Lautenschläger, Brensbach-Wersau (DE)

(73) Assignee: MEPLA-Werke Lautenschlager GmbH & Co. KG, Reinheim (DE)

( * ) Notice: Subject to any disclaimer, the term of this patent is extended or adjusted under 35 U.S.C. 154(b) by 0 days.

(21) Appl. No.: 09/486,118

(22) PCT Filed: Mar. 19, 1999

(86) PCT No.: PCT/EP99/01831

§ 371 (c)(1),
(2), (4) Date: Feb. 22, 2000

(87) PCT Pub. No.: WO99/51843

PCT Pub. Date: Oct. 14, 1999

(30) Foreign Application Priority Data

Apr. 1, 1998 (DE) ..... 298 05 876 U
Feb. 17, 1999 (DE) ..... 299 02 768 U

(51) Int. Cl.[7] ..... E05D 7/10
(52) U.S. Cl. ..... 16/258; 312/329
(58) Field of Search ..... 16/258, 257, 254, 16/382, 383; 312/329

(56) References Cited

U.S. PATENT DOCUMENTS 4,760,623 A * 8/1988 Toyama ..... 16/258
4,800,621 A * 1/1989 Röck et al. ..... 16/254
4,800,622 A * 1/1989 Röck et al. ..... 16/382
4,976,006 A * 12/1990 Lautenschläger ..... 16/257
5,056,189 A * 10/1991 Brüstle et al. ..... 16/258
5,085,491 A * 2/1992 Lautenschläger ..... 312/329
5,276,944 A * 1/1994 Lin ..... 16/258
5,937,479 A * 8/1999 Ohshima et al. ..... 16/258
6,032,333 A * 3/2000 Brüstle ..... 16/258
6,073,311 A * 6/2000 Lautenschläger ..... 16/383

FOREIGN PATENT DOCUMENTS

| | | | |
|---|---|---|---|
| AT | 382674 | 3/1987 | |
| DE | 8616146 | 9/1986 | |
| DE | 4214979 | 5/1992 | |
| DE | 9208650 | 10/1992 | |
| EP | 0225609 | 4/1986 | |
| EP | 0342293 A1 * | 11/1989 | ..... E05D/5/02 |

* cited by examiner

*Primary Examiner*—Lynne H. Browne
*Assistant Examiner*—Doug Hutton
(74) *Attorney, Agent, or Firm*—Norris McLaughlin & Marcus

(57) ABSTRACT

A mounting plate (10) for furniture hinges, composed of a lower mounting plate part (30), which can be fastened to the supporting wall of a piece of furniture and swiveled in its front end region, and of an upper mounting plate part (32), which can be detachably fastened in the rear end region by a snap-in connection. In its rear end region, the lower mounting plate part (30) has at least one projection (64), which protrudes upwards between side walls of the upper mounting plate part (32) and has at least one locking surface (68). At the upper mounting plate part, a swivel lock (54), with the locking surfaces of the projection or the projections (64) of the lower mounting plate part (30), is assigned to the projection (64). The swivel lock is place under tension by a spring (56) in a position forcing the locking engagement surfaces (76) into an engagement position with the locking surfaces (68).

11 Claims, 9 Drawing Sheets

MOUNTING PLATE FOR FURNITURE HINGES

BACKGROUND OF THE INVENTION

The invention relates to a mounting plate for adjustably holding the supporting wall fastening part of a furniture hinge. The mounting plate consists of two mounting plate parts, which can be separated from one another and of which the lower mounting plate part, which is closer to the supporting wall, can be fastened to the supporting wall of a piece of furniture and the upper mounting plate part, which is remote from the supporting wall and adjustably holds the part of the hinge fastened to the carcass, can be connected with the lower mounting plate part by a snap-in mechanism, it being possible to hook together the front end regions of the two mounting plate parts facing the leaf of the door, and the upper mounting plate part, produced with the inverted U-shaped cross section, being constructed so that its end region within the carcass can be swiveled downward about an axis extending parallel to the swivel pin of the hinge to be attached to the upper mounting plate onto the end region of the lower mounting plate part within the carcass, its side walls, formed by the lateral U-shaped legs and canted up from the cross member wall, in each case laterally overlapping the lower mounting plate part and the snap-in mechanism having a swivel lock, which is mounted in the rear end region of the upper mounting plate part and is provided with a handle and at least one locking engagement surface and, in the swiveling position, in which the locking engagement surface or surfaces in each case grips or grip behind an assigned locking surface at the lower mounting plate part, is put under tension by a spring by swiveling the swivel lock against the tension of the spring, but nevertheless can be disengaged.

In the case of hinges held with such mounting plates at the supporting wall of the carcass of a cabinet, cupboard or wardrobe, it is possible to loosen the supporting arms of the hinges, mounted, on the other hand, at the door leaf, individually consecutively from the supporting wall or to fasten them to it without difficult manipulations being possible in that the snap-in mechanism is actuated and the hinge supporting arm then, together with the upper mounting plate part, which is connected with it, is then swiveled up or, after suspension at the lower mounting plate part, swiveled down. This is of advantage particularly for high wardrobes, for which the door leaves are fastened with more than two hinges to the carcass of a cabinet, cupboard or wardrobe, because the door leaves can then be taken down, as well as put up again by individual persons. The snap-in mechanism of the known hinge (AT 382 675 B) is formed by a swivel lock on the rear end of the upper mounting plate part, which can be swiveled about a transverse axis and is elastically pre-tensioned in a swiveling end position and at the one end of which a hook part, undergrasping the lower mounting plate part in the snapped-in position of the rear end, is formed, while its other end is taken out of the end within the carcass and forms the actuating handle of the snap-in mechanism, by means of which the hook part can be swung out of the undergrasping snap-in position against the force of a spring. This snap-in mechanism is quite efficient. However, it is structurally relatively expensive. In addition, the hinges, which can be fastened on the known mounting plate, must have a specially shaped supporting arm which, deviating from the supporting arms customary for hinges at the present time, at the end within the carcasses, does not have an open fastening slot which, during the mounting of the hinge, can be pushed onto the mounting plate below the loosened fastening screw.

On the other hand, it is an object of the invention to simplify and improve the generic mounting plate, so that it can also be used for adjustably holding normal, mass produced hinges.

Starting out from a hinge of the above-mentioned type, this objective is accomplished pursuant to the invention owing to the fact that the lower mounting plate part, in its rear end region within the carcass, has on opposite sides of its longitudinal center line in each case one projection protruding upwards in the intended locking engagement position between the side walls of the upper mounting plate part, at which in each case one of the locking surfaces is formed, that the swivel lock is mounted in the upper mounting plate part so that it can be rotated about a swivel pin lying in the intended locking engagement position by the upper and lower mounting plate parts below the locking surface of the lower mounting plate part and has shoulders, which protrude towards opposite sides and at which the locking engagement surfaces are formed, and that the spring, putting the swivel lock under tension in the locking engagement position, is supported at the upper mounting plate part on the one hand and at the swivel lock on the other. A reliable locking engagement is ensured by locking the upper mounting plate part to the lower mounting plate part at the locking surfaces by the two projections, which are spaced apart from one another, the support of the pre-tension of the spring between the upper mounting plate part and the swivel lock making it possible that the supporting arm of a hinge, which is to be fastened on the mounting plate, does not have to be adapted to the snap-in mechanism. It is thus readily possible to construct the mounting plate in such a manner, that conventional, serially produced hinges can be fastened adjustably on it. Because the swiveling pin of the swivel lock is disposed in such a manner, that it is positioned in the intended locking position beneath the engaged locking surfaces, the swivel lock, when acted upon by stresses, which act on a hinge, held in the mounting plate, in the sense of a swiveling up of the upper mounting plate part relative to the lower mounting plate part, is acted upon by compression forces as if it were a catch. Compared to the stresses on the hook part of the swivel lock by bending forces corresponding the state of the art, the swivel lock, positioned in the inventive manner, can therefore be subjected to higher stresses.

In this connection, the upper mounting plate part is preferably constructed as a part, punched or pressed out of sheet metal.

In a preferred further development of the invention, the lower mounting plate part is also constructed from a part, which is punched or pressed out of sheet metal and, in the region overlapped in the intended locking engagement position of the upper and the lower mounting plate parts by the side walls of the upper mounting plate part, has at least sectionally also an inverted U-shaped cross section with two side walls, angled from a cross member wall and formed by the legs of the U, the projections, provided with the locking surfaces, being formed by sections of the side walls of the lower mounting plate part, which lie at the end region within the carcass and are not connected by the cross member wall.

The embodiment is then advantageously such that, in the side wall sections, which are in the interior of the carcass and not connected by the cross member walls, open recesses are provided, which open out upwards ahead of the projections and in which the shoulders of the swivel lock, which protrude towards opposite sides and are provided with the locking engagement surfaces, are disposed retractably and in the intended locking engagement position. The locking engagement surfaces at the shoulders can then be disposed at the shoulders so that they are aligned with the locking surfaces of the projections. At the same time, the shoulders can be widened so that they fit accurately between the side walls of the upper mounting plate part, so that a lateral shifting of the swivel lock and thus a disengagement of the locking surfaces of the projections and of the locking engagement surfaces of the swivel lock is reliably precluded.

The locking surfaces at the outwardly protruding shoulders of the swivel lock are advisably disposed so that they extend essentially tangentially in the unlocking or swiveling direction, the complementary locking engagement surfaces, formed at the projections of the lower mounting plate part, then being constructed at the underside by lobe-like shoulders provided in the region of the free ends of the projections. By means of this arrangement of the locking surfaces and the locking engagement surfaces, it is ensured that the forces, exerted by the user on the swivel lock during an unlocking, are relatively small while, on the other hand, there is no danger that the snap-in mechanism will be released inadvertently by external impacts, for example, while fastening the door leaf in the open position.

The spring, putting the swivel lock under tension, preferably is a spiral spring under tension, which is supported, on the one hand, at an extension of the cross member wall of the upper mounting plate part pointing into the interior of the carcass and, on the other, at the side of the swivel lock facing this extension. It may be advisable to hold the opposite ends of the spiral spring in each case in a depression in the extended section of the cross member wall of the upper mounting plate part or in a depression in the swivel lock, as a result of which it is ensured that the spiral spring can not be lost.

The hooking-in connection, which is provided pursuant to the invention and enables the upper mounting plate part to be swiveled on the lower mounting plate part, is realized according to one example of the invention owing to the fact that, in the end of the lower mounting plate part within the carcass, at least one slot-like seat, which is open in the direction of the interior of the carcass, tapers conically and is rounded circularly at the rear closed end, is provided and that, in the front end region of the upper mounting plate part, a transversely extending pin, which is held in the side walls of the upper mounting plate part and can be hooked into the seat or seats of the lower mounting plate part, is provided.

In the case of a second example, the hooking-in connection is realized, on the other hand, owing to the fact that, in the end region of the lower mounting plate part within the carcass, in each case one peg-like shoulder, protruding in each case in opposite directions, is provided, the common longitudinal center line of which extends parallel to the swivel pin of a hinge, which is to be fastened on the mounting plate, and that, in the side walls of the upper mounting plate part, in each case a hook mounting, which is open at the end that is directed into the interior of the carcass in the intended locking position, and constructed circularly rounded at its front closed end, in which hook mounting the peg-like projections of the lower mounting plate part can be suspended.

It may be advantageous if the side walls of the upper mounting plate part, in the region of the hook mounting, are reinforced to counter deformations owing to the fact that, in the front end region of the upper mounting plate part, between the side walls of the latter, a transversely extending pin is provided, which is fixed in boreholes of the side walls, for example by riveting or nutation.

Finally, a refinement of the hooking-in connection between the upper mounting plate part and the lower mounting plate part is also possible according to a further modification of the invention owing to the fact that, at the end of the lower mounting plate part outside of the carcass, at least one arc-shaped shoulder is provided, which protrudes from the end outside of the carcass and, at the end of the upper mounting plate part outside of the carcass, a hooked projection is formed from an extension of the cross member wall of the upper mounting plate part. The projection or projections of the lower mounting plate part can be suspended in this hooked projection.

BRIEF DESCRIPTION OF THE DRAWINGS

The invention is explained in greater detail in the following description of several examples and in conjunction with the drawing, in which.

DESCRIPTION OF THE PREFERRED EMBODIMENT

Figure 1:
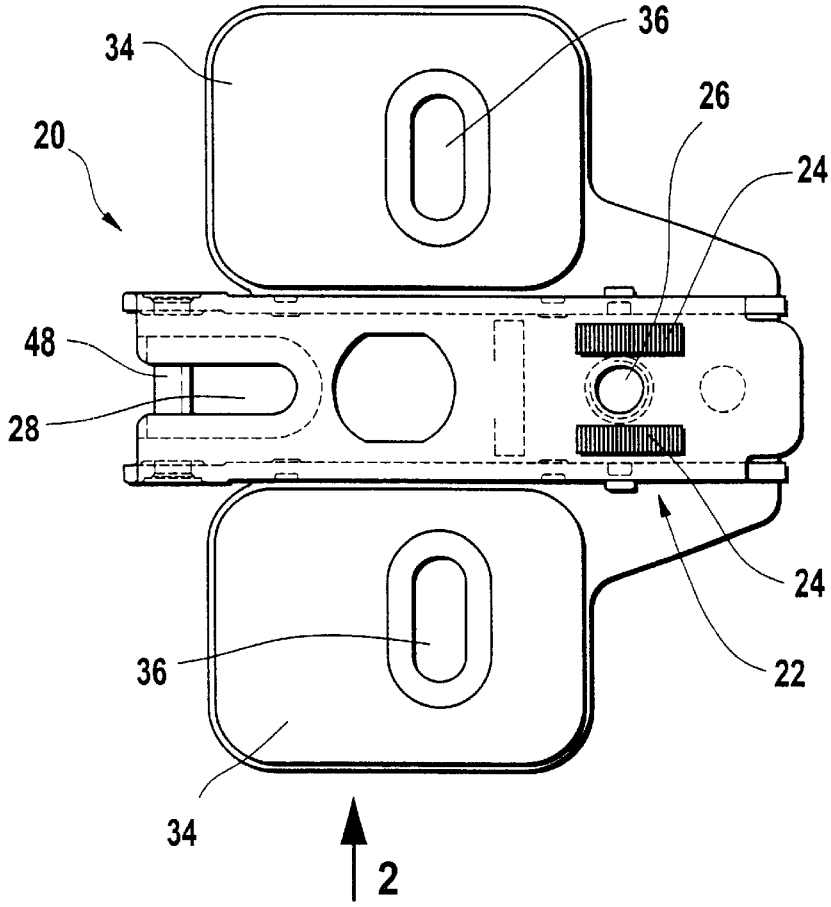
FIG. 1 shows a plan view of a first example of a mounting plate, constructed in the inventive manner, FIGS. 2–4 in each case show a side view of the mounting plate, as seen in the direction of the arrow 2 in FIG. 1, in differently swiveled positions of the upper part of the mounting plate relative to the lower mounting plate part.

In FIGS. 1 to 4, a mounting plate is shown, which is labeled 20 as a whole and constructed in the inventive manner and on which the supporting wall fastening part is constructed as a long, stretched-out supporting arm and forms part of an articulated hinge, which in other respects corresponds to the state of the art and is therefore not shown nor described in detail, is adjustably fastened. With respect to the particulars of the supporting arm of the hinge, which is to be fastened to the mounting plate 20, it may be sufficient to refer to the design of the hinge, which is described in FIGS. 1 and 2 of the DE-35 25 279 A1, and to the associated specification.

The mounting plate 20 has a long, stretched-out, strip-shaped holding section 22, in the rear end region of which, that is, the end region pointing into the interior of the carcass, within a region provided with transverse corrugations 24, a threaded borehole 26 is provided, into which the shaft of a fastening screw, which is not shown and is intended to fasten the supporting arm of a hinge, can be screwed. In the front end region, that is, in the end region pointing out of the interior of the carcass, the holding section 22 has a slot-shaped recess 28, which opens up in the front end surface and, at the upper side, is opened for the passage of the neck section of a (not shown) setscrew for adjusting the extent of opening of the door leaf.

The actual mounting plate 20 is constructed in two parts and consists of a lower mounting plate part 30 (FIGS. 9 to 11), which is to be fastened directly to the supporting wall of the carcass, and an upper mounting plate part 32 (FIGS. 5 to 8), which is locked onto the lower mounting plate part 30.

In the case shown, the mounting plate 20 is constructed as a so-called wing plate, for which a wing stub 34, which usually is used to fasten the mounting plate to the supporting wall, protrudes at opposite sides from the central holding section 22 for the adjustable fastening of an associated hinge supporting arm.

In the wing stubs 34, countersunk elongated holes 36 are provided, through which (not shown) fastening screws can be screwed into boreholes of the supporting wall of a piece of furniture, to which wall the mounting plate 20 is to be fastened. Within the limits of the length of the longitudinal slot 36, the height of the mounting plate 20 can be adjusted when the fastening screws are loosened.

The upper mounting plate part 32, shown separately in FIGS. 5 to 8, has an inverted U-shaped cross section, that is, it consists of an upper, long, stretched-out cross member wall 42 and, fastened to the opposite longitudinal edges of the cross member wall 42, a central, strip-shaped, upwardly protruding section 38 of the lower mounting plate part 30, laterally partially overlapping side walls 44. In the cross member wall 42, the open slot-shaped recess 28 and a continuous opening 46 are provided. In the special case, that is, in interaction with the lower mounting plate part 30, the continuous opening 46 has no function. However, in the case of a deviating configuration of the lower mounting plate part with a separate height adjustable middle part, it provides access to a fastening screw combining this middle part with the actual wing plate.

Figure 12:
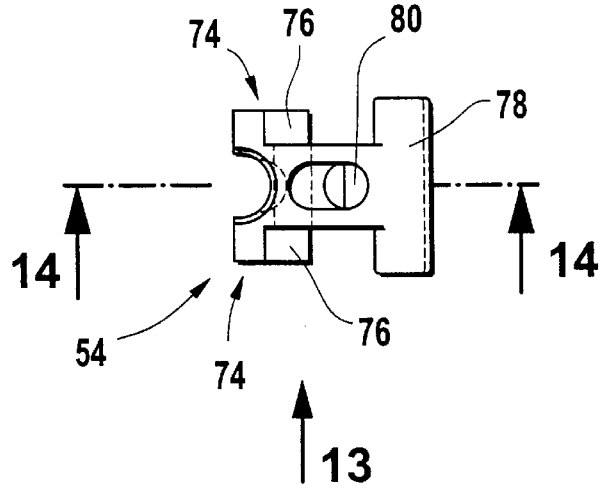
FIG. 12 shows a plan view of the swivel lock of the inventive mounting plate, alternately locking and releasing the upper mounting plate part on the lower mounting plate part.
Figure 13:
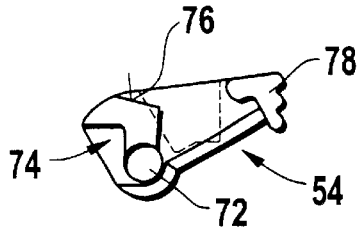
FIG. 13 shows a side view of the swivel lock, as seen in the direction of arrow 13 in FIG. 12.
Figure 14:
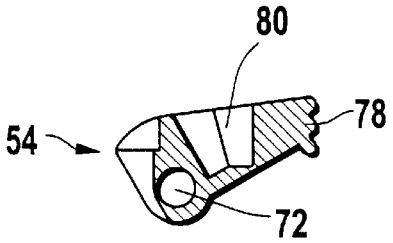
FIG. 14 shows a sectional view, as seen in the direction of the arrows 14—14 in FIG. 12.
Figure 15:
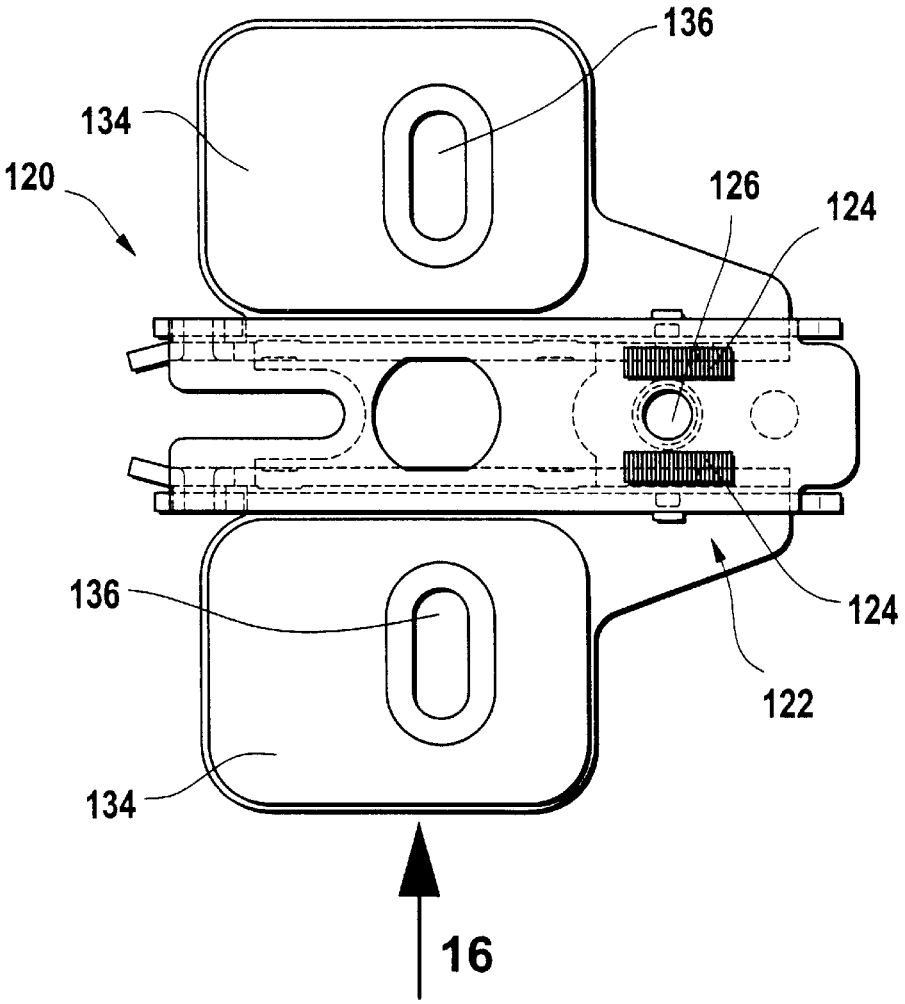
FIG. 15 shows a plan view of a second example of a mounting plate, constructed in the inventive manner.
Figure 16:
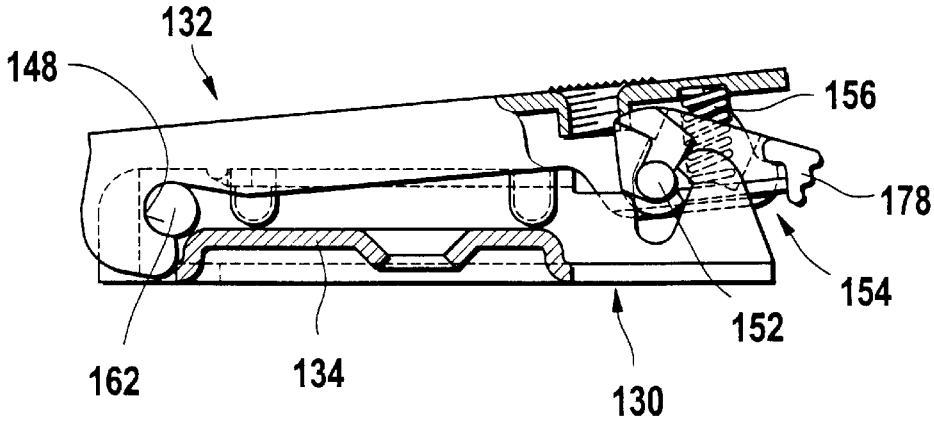
FIG. 16 shows a partially open side view of the mounting plate, as seen in the direction of arrow 16 in FIG. 15, in a still unlocked swiveling position of the upper mounting plate part, the rear end of which is slightly raised, FIGS. 17 and 18 each show separate views of the upper and lower mounting plate parts in the representation corresponding to FIG. 16.
Figure 17:
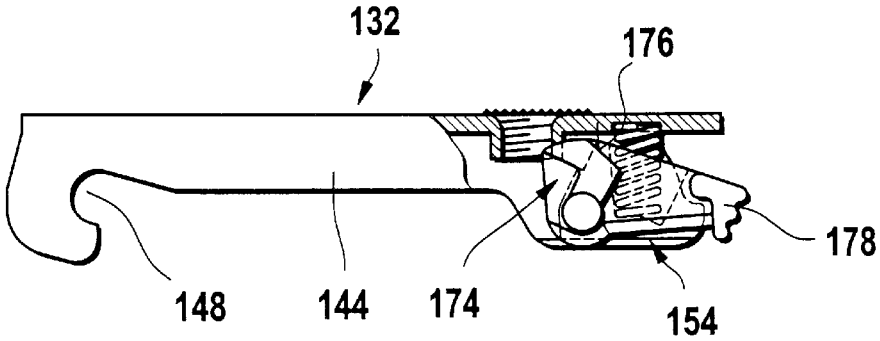
Figure 18:
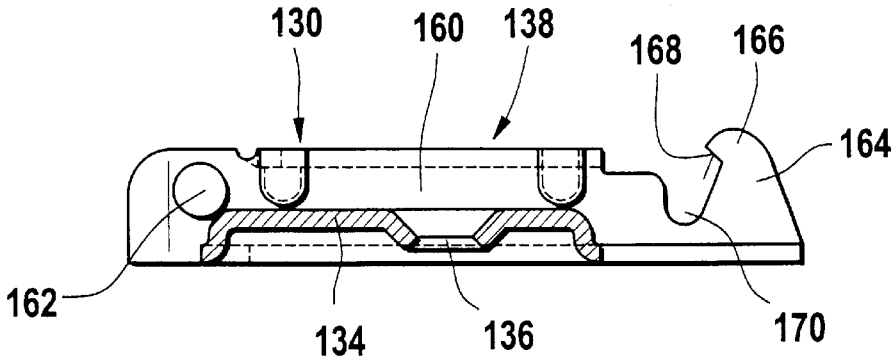
Figure 19:
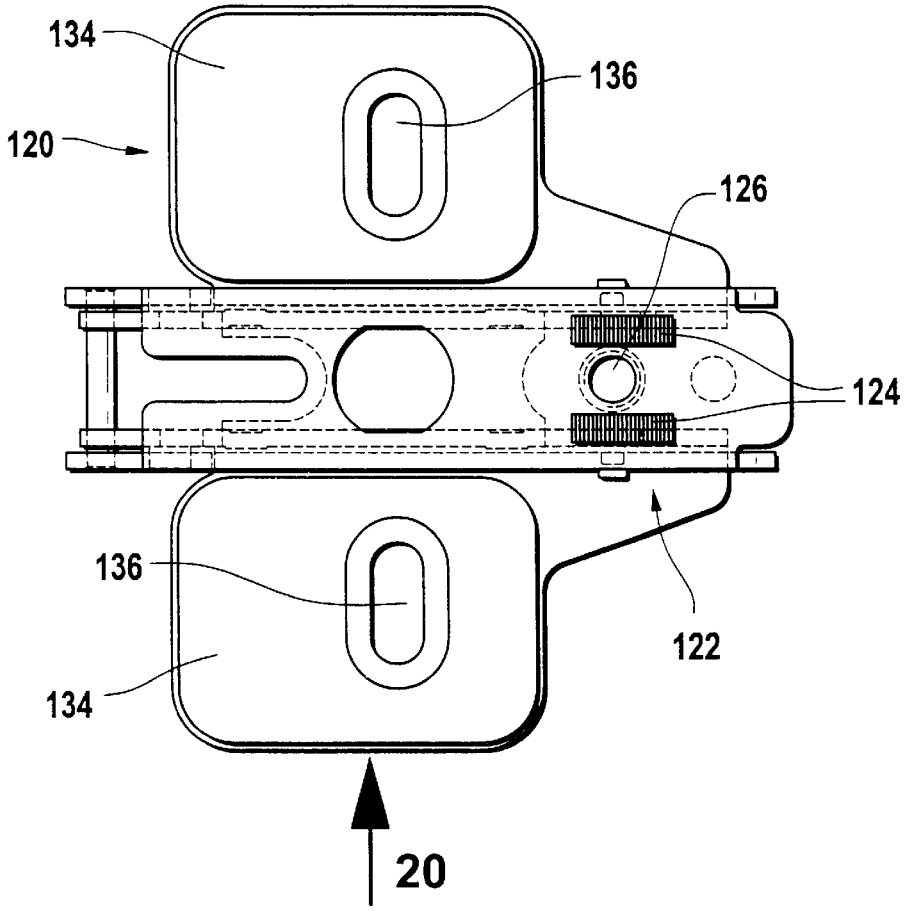
FIG. 19 shows a plan view of a third example of a mounting plate, constructed in the inventive manner.
Figure 20:
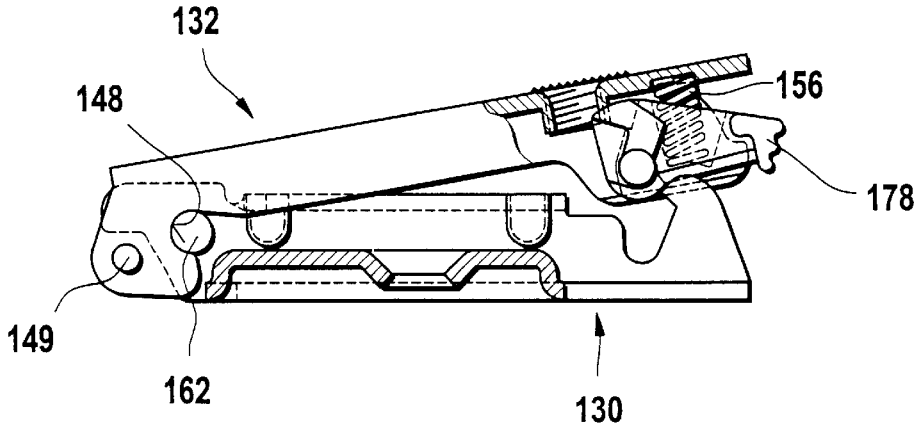
FIG. 20 shows a partially open side view of the mounting plate, seen in the direction of arrow 20 in FIG. 19 in a representation corresponding to that of FIG. 16, FIGS. 21 and 22 each show separate representations of the upper and lower mounting plate parts in the representation of FIG. 20.
Figure 21:
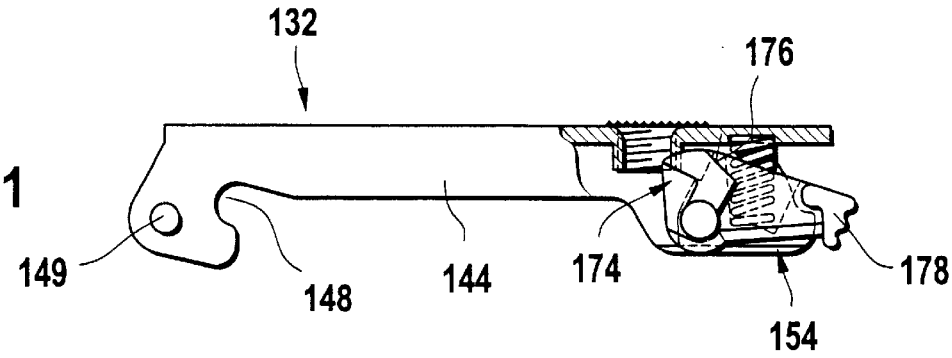
Figure 22:
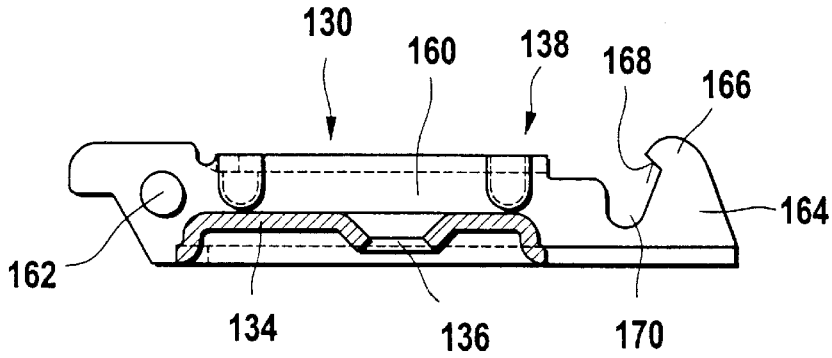
Figure 23:
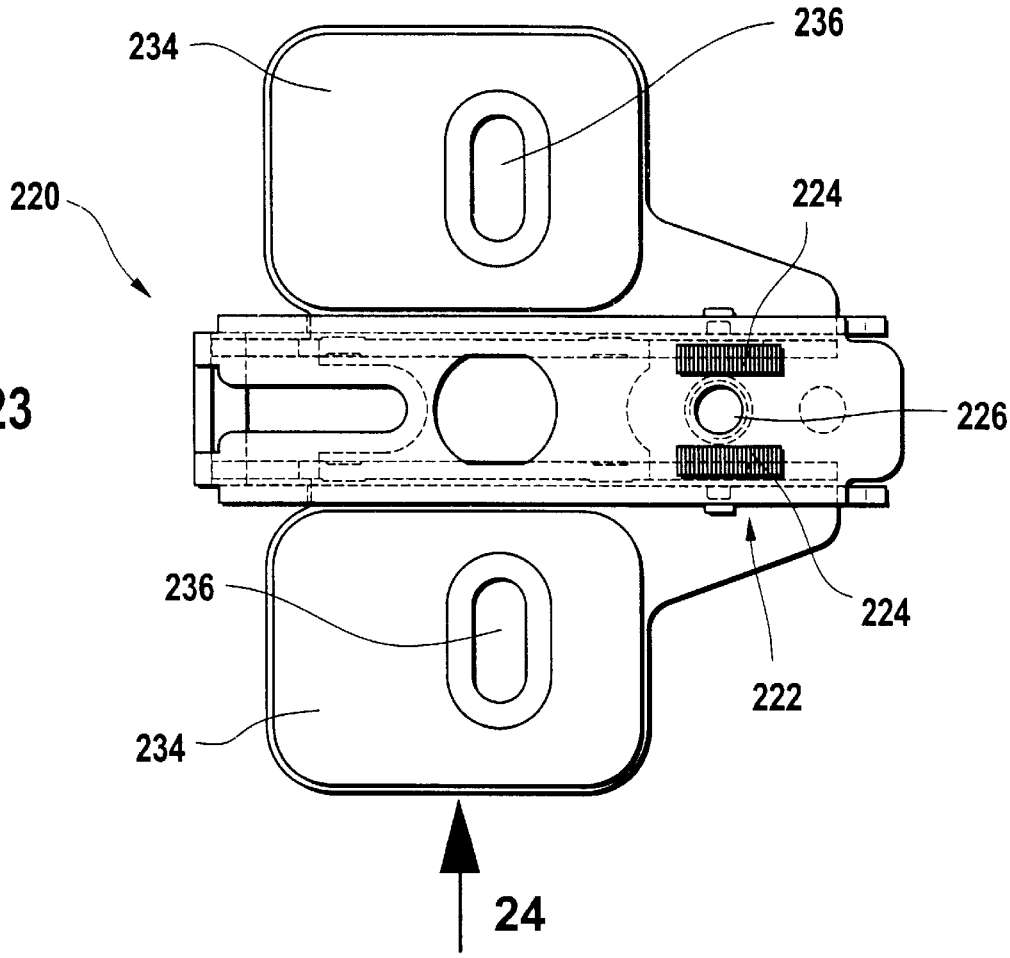
FIG. 23 shows a plan view of a fourth example of a mounting plate constructed in the inventive manner.
Figure 24:
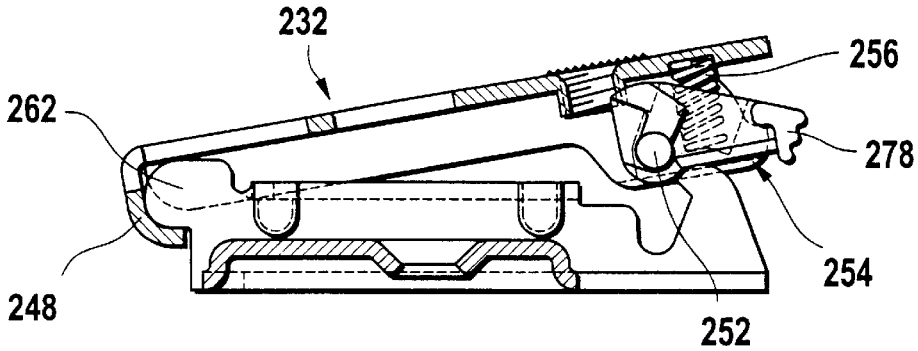
FIG. 24 shows a view of the upper and lower mounting plate parts, as seen in the direction of arrow 24 in FIG. 23, for which the rear end of the upper mounting plate part, shown in the longitudinal cross section, is represented swiveled up into a position above the locking position and FIGS. 25 and 26 each show separate views of the upper and the lower mounting plate parts in a representation corresponding to that of FIG. 20.
Figure 25:
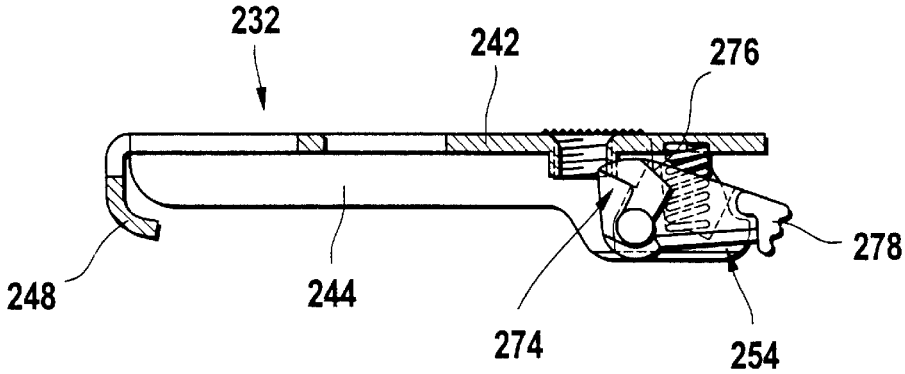
Figure 26:
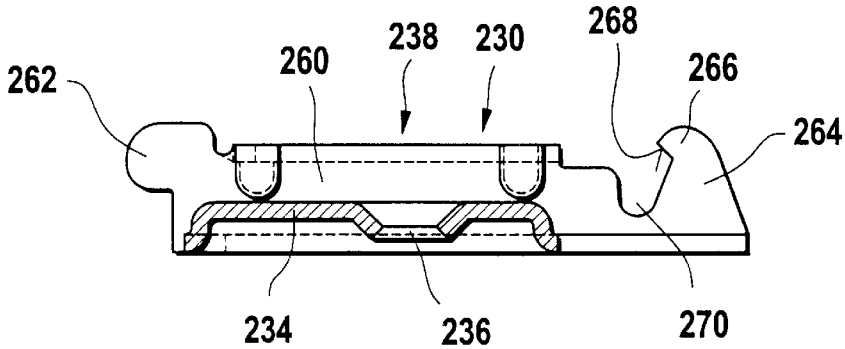

Below the slot-shaped recess 28, a transversely extending pin 48, riveted with its ends in the side walls 44 of the upper mounting plate part 32, is provided. In the manner still to be described in the following, the pin 48 can be hooked into the front end, that is, the end outside of the carcass of the lower mounting plate part 30, which is shown separately in FIGS. 9 to 11, in such a manner, that the rear end, that is, the end inside the carcass of the upper mounting plate part 32, can be swiveled up or down on the lower mounting plate part 30 about the pin 48 as a swivel pin. In the rear end region located opposite the pin 48, a borehole 50 is provided in the side walls 44 in a wall section enlarged downwards. In each case, the end of a hinge pin 52 (FIGS. 2 to 4), on which the swivel lock 54, which is shown separately in FIGS. 12 to 14, is pivotably mounted, is held in the borehole 50. Between the underside of the cross member wall 42 of the upper mounting plate part 32 and the upper side of the swivel lock facing the latter, a spiral spring 56 (FIGS. 2 to 4) is disposed under compression and, based on the representation of FIGS. 2 to 4, places the swivel lock under tension in the clockwise direction, in the end position illustrated in FIGS. 2 and 4.

Figure 9:
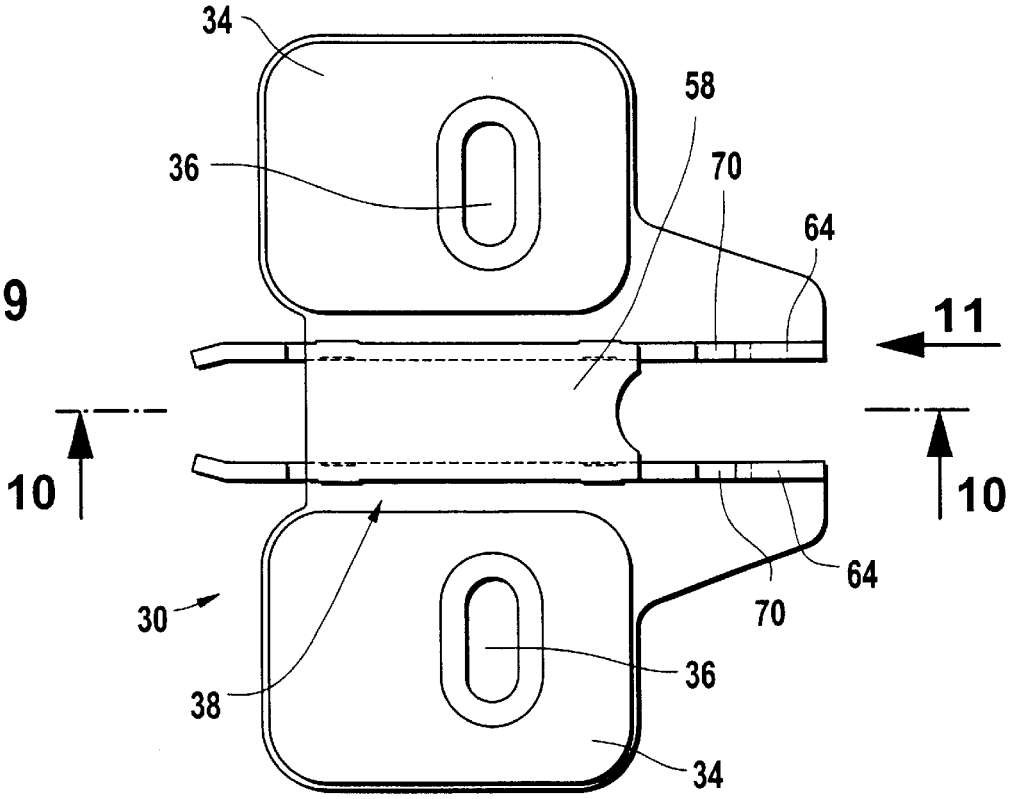
FIG. 9 shows a plan view of the lower mounting plate part of the mounting plate shown in FIGS. 1 to 4.
Figure 10:
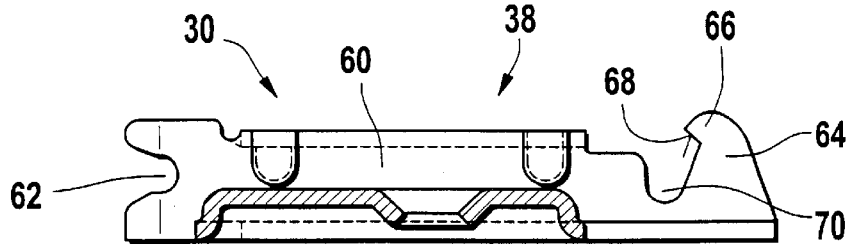
FIG. 10 shows a sectional view as seen in the direction of the arrow 10—10 in FIG. 3.
Figure 11:
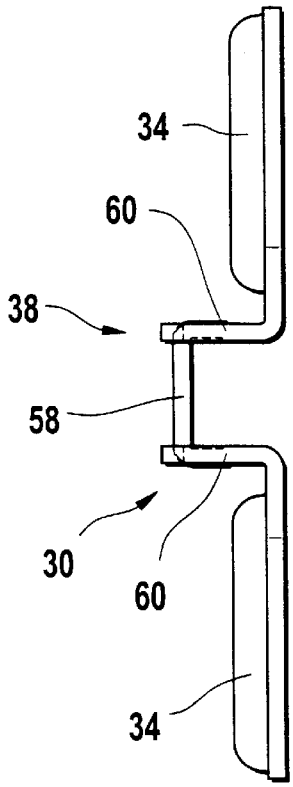
FIG. 11 shows a view as seen the direction of the arrow 11 in FIG. 9.

The lower mounting plate part 30, shown in FIGS. 9 to 11, is in the special case a part, which is punched or pressed out of sheet metal and, in its above-mentioned central strip-shaped upwardly protruding section 38, lying between the wing stubs 34, also has an inverted U-shaped cross section. The width of the section 38, measured over the exteriors of the side walls 60, joined at right angles to the edges of the cross member wall 58, is a little smaller than the clear width of the upper mounting plate part 32, measured between the side walls 44.

The side walls 60 protrude beyond the cross member wall 58 in the direction of the front end, that is, the end outside of the carcass, as well as in the direction of the rear end, that is, the end within the carcass. In each case, a slot-like mounting 62, which tapers conically and is rounded semi-circularly at the lower end and in which the pin 48 of the upper mounting plate part 32 can be suspended, is provided in the front leading edge of the side walls 60.

In opposite end regions, the side walls 60 in each case form an upwardly pointing projection 64, the upper free ends of which in each case end in a forwardly protruding lobe-like projection 66, the obliquely extending underedge of which in each case forms a locking surface 68 (FIG. 10). In front of the projection 64, recesses 70, which are open in the upward direction, are cut into the side walls 60. The hinge pin 52, which holds the swivel lock 54 pivotably, can pass through the recesses 70 as the inner end of the upper mounting plate part 32 swivels down counterclockwise into the locking engagement position (FIG. 4).

The swivel lock 54, mounted by means of the hinge pin 52 at the end of the upper mounting plate part, which is within the carcass, has between the side walls 44 of the mounting plate part and above its bearing borehole 72, through which the hinge pin 52 passes, shoulders 74, which protrude towards opposite sides and in each case have a locking engagement surface 76 which, in the intended locking engagement position, grips below the locking surface 68 of the assigned projection 64 of the lower mounting plate part 30. At the end of the swivel lock 54, pointing into the interior of the carcass, a broadened handle 78, corrugated by transverse ribs, is integrally molded and enables the swivel lock to swivel in the counter-clockwise direction. The locking engagement surface 76 is then released from the engagement position with the locking surface 68 of the projections 64 and the upper mounting plate part 32 can be swiveled upward in the counter-clockwise direction and the pin 48 can then be unhooked from the seat 62 of the lower mounting plate part 30. A supporting arm of a hinge, optionally mounted on the upper mounting plate part 32, can thus be detached from the mounting plate part 30 mounted on the supporting wall of a carcass of a cabinet, cupboard or wardrobe and mounted once again without any change in an adjustment of the supporting arm on the mounting plate 10 and, with that, without any change in the alignment of a door leaf fastened with the hinge in question to the carcass. A depression 80, in which one end of the spiral spring 56 is held, is provided in the upper side of the swivel lock facing the cross member wall 42 of the upper mounting plate part 32. The other end of the spiral spring engages a low depression 82 in the underside of the cross member wall 42.

Figure 2:
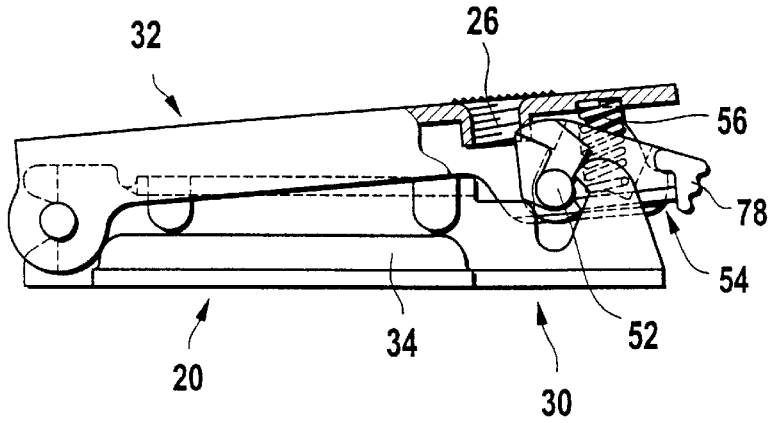
Figure 3:
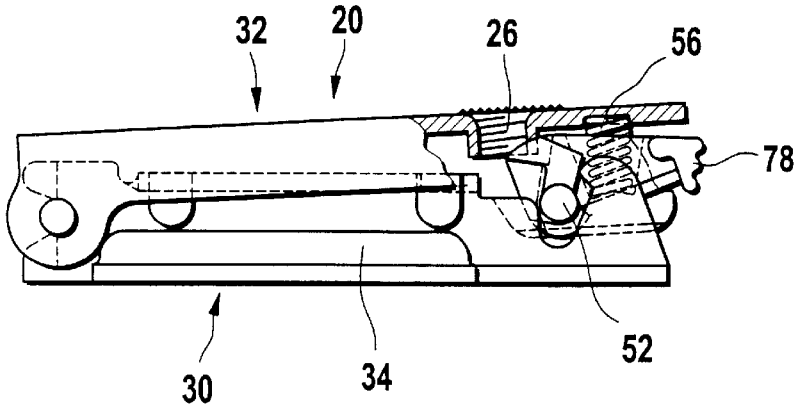
Figure 4:
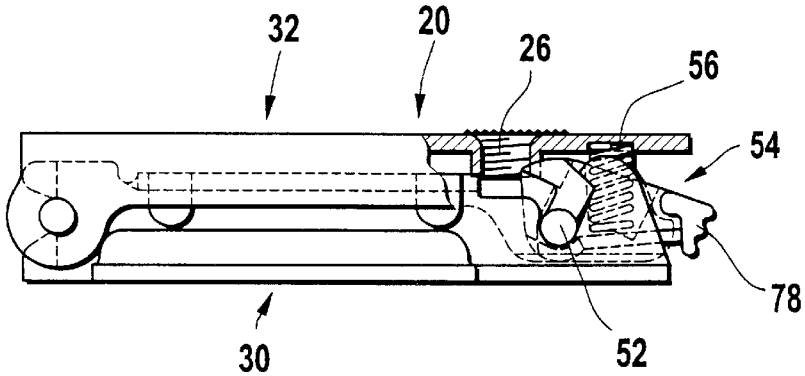
Figure 5:
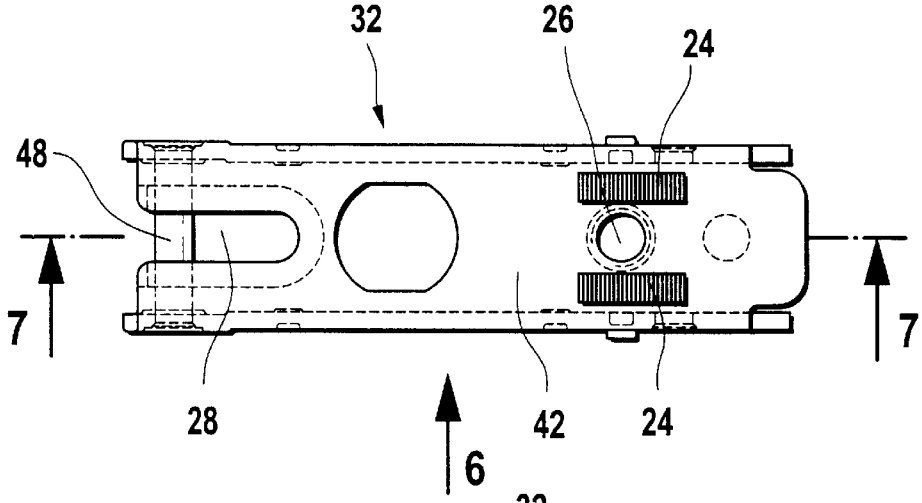
FIG. 5 shows a plan view of the upper mounting plate part of the mounting plate shown in FIGS. 1 to 4.
Figure 6:
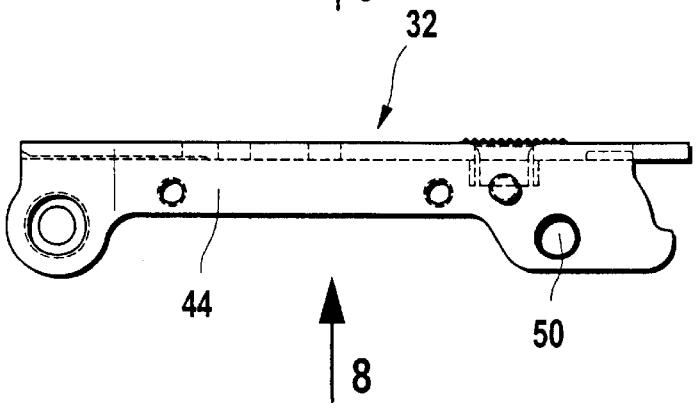
FIG. 6 shows a side view of the upper mounting plate part as seen in the direction of the arrow 6 in FIG. 5.
Figure 7:
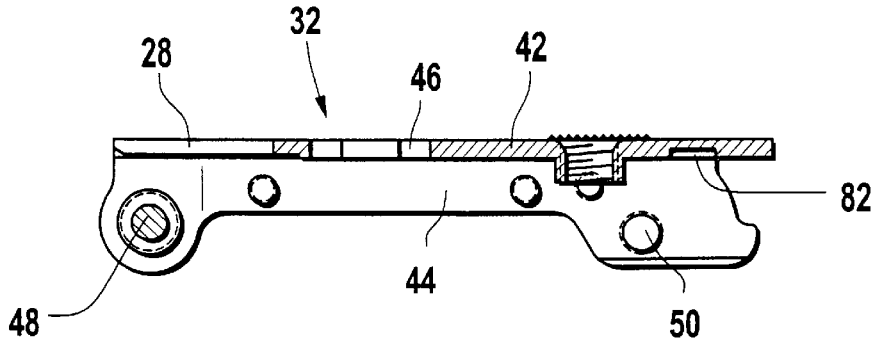
FIG. 7 shows a sectional view as seen in the direction of the arrow 7—7 in FIG. 5.
Figure 8:
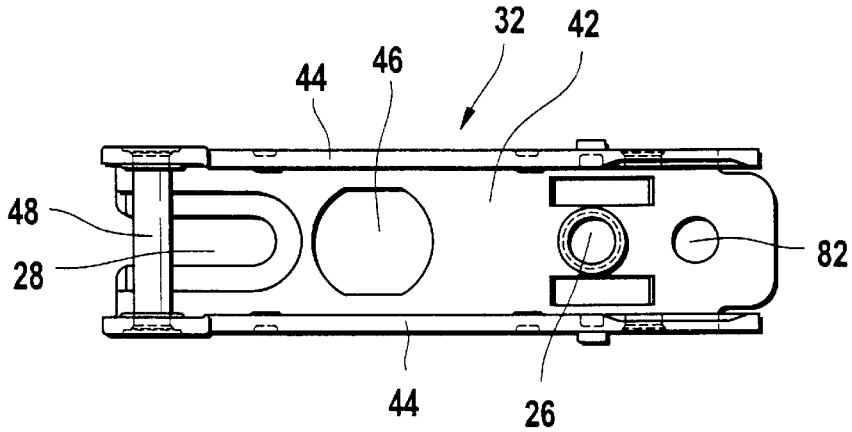
FIG. 8 shows a view from below of the upper mounting plate part as seen in the direction of the arrow 8 in FIG. 6.

In FIGS. 2 to 4, it can be seen how the locking of the upper mounting plate part 32, suspended with the hinge pin 48 in the, seat 62 of the lower mounting plate part 30, is brought about. The inner end of the upper mounting plate part 32 is swiveled down onto the lower mounting plate part 30. In the position shown in FIG. 2, the laterally protruding shoulders 74 of the swivel lock 54 come up against the upper side of the lobe-like shoulders 66, so that, as it is swiveled down further, the swivel lock 54 is swiveled counter-clockwise (FIG. 3) until the locking engagement surfaces 76 are aligned with the locking surfaces 68 of the projections 64 and the spring 56 allows the swivel lock, acting as catch, to snap back then in the counter-clockwise direction into the locking engagement position (FIG. 4), in which the two mounting plate parts 30, 32 can be connected with one another without clearance. The disassembly is carried out conversely by swiveling the swiveling lever by taking hold of and swiveling up the handle 78 of the swivel lock 54, by means of which the locking engagement surfaces 76 are disengaged from the locking surfaces 68, so that the upper mounting plate part 32 can then be swiveled further upwards and the hinge pin 48 can be unhooked from the seat 72.

In FIGS. 15 to 18, a modified example of an inventive mounting plate, which is labeled 120 as a whole, is described. It differs from the mounting plate, described above in connection with FIGS. 1 to 14, only in the design of the hooking-in connection, which enables the inner end of the upper mounting plate part to be swiveled onto the lower mounting plate part and is located in the end region of the two mounting plate parts outside of the carcass. Therefore, to avoid unnecessary repetitions, only the deviating construction of the upper and lower mounting plate parts in the region of this connection is described. With respect to the design of the mounting plate in other respects and, moreover, particularly also in regard to the design of the locking means at the end of the mounting plate within the carcass, it is sufficient to refer to the previous description, particularly as identical functional parts of the mounting plates 20 and 120 have been assigned the same reference numbers in the drawing, with the exception that, in the case of the mounting plate 120, a "1" precedes the number.

To form the hooking-in connection, which makes the swiveling of the upper mounting plate part 132 on the lower mounting plate part 130 possible in the case of the mounting plate 120, in each case a peg-like shoulder 162, protruding centrally upward and in opposite direction from the side walls 160 of the section 138, is provided in the end region, outside of the carcass, of the lower mounting plate part 130. The longitudinal center line of the peg-like shoulders 162 are aligned.

In each case a hook seat 148, open at its end directed into the interior of the carcass in the intended locking position and rounded off circularly at its front end, is formed in the side walls 144 of the upper mounting plate part 132. In the position, in which the rear end is raised, the upper mounting plate part can be guided over the section 138 of the lower mounting plate part in such a manner, that the peg-like shoulders 162 lie in the hook seat 148. If the upper mounting plate part 132 is then swiveled in the downward direction with its rear end, the two mounting plate parts are locked together in the already described manner and can be unlocked only by actuating the swivel lock 154, whereupon the upper mounting plate part 132 is swiveled up once again and can be removed from the peg-like shoulders 162.

The example of the inventive mounting plate 120, shown in FIGS. 19 to 22, differs from the mounting plate described above only owing to the fact that the side walls 144 of the upper mounting plate part 132 are deformationally stabilized in the end region outside of the carcass additionally by a pin 149, which is provided before the hook seat 148, extends transversely and is riveted or nutated in the side walls.

In the case of the further modified example of an inventive mounting plate 220, shown in FIGS. 23 to 26, the side walls 260 of the lower mounting plate part 230 have at their front ends a shoulder 262, which in each case protrudes out of the interior of the carcass and has an arc-shaped boundary, and the cross member wall 222 of the upper mounting plate part 232 is elongated at its front end outside of the carcass and bent over into a hooked projection 248, which can be guided over the shoulders 262 with the arc-shaped boundary and suspended from them. In other respects, the mounting plate 220 once again is identical with the examples described above. A more detailed description can therefore be omitted, particularly since here also once again, the same reference numbers have been used for parts functionally identical with those of the preceding examples, with the difference that the numbers are preceded by a "2".

It can be seen that, within the scope of the inventive concept, modifications and further developments of the example described can be realized, which relate, for example, to the fact that one or also both mounting plate parts can be constructed as zinc pressure diecasting parts. Instead of the spiral spring 56 under compression, a different suitable spring, such as a leg spring can also be provided, the one leg of which is supported at the upper mounting plate part 32 and the other leg at the swivel lock 54.

What is claimed is:

1. A mounting plate (10; 110; 210) for adjustably retaining a furniture hinge, said mounting plate comprising:

a lower mounting plate part (30; 130; 230) situated proximate to and fastened to a supporting wall of a carcass of a piece of furniture, said lower mounting plate part having side walls (60), a front end region pointing out of the interior of said carcass and a rear end region pointing into the interior of said carcass, wherein said rear end region includes at least one open recess (70; 170; 270) which opens upward and, on each opposite side of its longitudinal center line, a projection (64; 164; 254) protruding upwards;

an upper mounting plate part (32; 132;232) situated remote from said supporting wall and connected to said lower mounting plate part by a snap-in mechanism wherein said upper mounting plate part adjustably retains said furniture hinge, said upper mounting plate part having a front end region pointing out of the interior of said carcass and a rear end region pointing into the interior of said carcass, said upper mounting plate part further comprising a cross member wall (42; 142; 242) having lateral U-shaped legs to form side walls (44; 144; 244), wherein said sidewalls laterally overlap said lower mounting plate part when said rear end region of said upper mounting plate part is swiveled downward onto said rear end region of said lower mounting plate part about an axis extending parallel about a second hinge pin (48) attached transversely to said side walls of said upper mounting plate part; and said snap-in mechanism having a swivel lock (54; 154; 254) rotatably mounted about a second hinge pin (52) in said rear end region of said upper mounting plate, wherein said swivel lock is provided with a handle (78) and shoulders (74; 174; 274) integral to said swivel lock, extending laterally in opposing directions to form at least one locking engagement surface (76; 176; 276) which grips a locking surface (68; 168; 268) at the rear end region of said lower mounting plate part in a locking engagement position when said rear end region of said upper mounting plate part is swiveled downward onto said rear end region of said lower mounting plate part and said swivel lock is put under tension by a spring (56; 156; 256) supported at one end by said upper mounting plate part and at an opposite end by said swivel lock, said at least one locking engagement surface (76; 176; 276) extending in said locking position essentially tangentially in the unlocking swiveling direction of the swivel lock (54; 154; 254).

2. The mounting plate of claim 1, wherein said projections (64; 164; 254) are formed by sidewalls (60; 160; 260) of said lower mounting plate part (30; 130; 230).

3. The mounting plate of claim 1, wherein said projection (64; 164; 264) of said lower mounting plate part includes a lobe-like shoulder (66; 166; 266).

4. The mounting plate of claim 1, wherein said upper mounting plate part (32; 132; 232) is punched or pressed out of sheet metal.

5. The mounting plate of claim 1, wherein said lower mounting plate part (30; 130; 230) is punched or pressed out of sheet metal.

6. The mounting plate of claim 1, wherein said spring is a spiral spring under tension supported by an extension of said cross member wall of said upper mounting plate part and at a face of said swivel lock facing said extension.

7. The mounting plate of claim 6, wherein opposite ends of said spiral spring are held in a first depression (82; 182; 282) in said extension of said cross member of said upper mounting plate part or in a second depression (80; 180; 280) in said swivel lock.

8. The mounting plate of claim 1, wherein said front end region of said lower mounting plate part includes at least one slot-like mounting (62) which opens in the direction of the exterior of said carcass, said slot-like mounting tapered conically and rounded circularly and wherein said first hinge pin (48) can be hooked into said at least one slot-like mounting.

9. The mounting plate of claim 1, wherein said front end region of said lower mounting plate part includes at least one peg-like shoulder (162) protruding outward in opposing directions from side walls (60; 160) of said lower mounting plate part and parallel to said first hinge pin (48), and wherein said sidewalls (144) at said front end region of said upper mounting plate part (132) form a hook seat (148) in which said at least one peg-like shoulder (162) can be suspended and swiveled.

10. The mounting plate of claim 9, wherein said front end region of said upper mounting plate part (132) includes between said sidewalls (144) of said upper mounting plate a transversely extending pin (149) fixed in a pair of boreholes in said sidewalls (144).

11. The mounting plate of claim 1, wherein said front end region of said lower mounting plate part (230) includes at least one arc-shaped shoulder (262) and wherein said from end region of said upper mounting plate part (232) includes a hooked projection (248) formed from an extension of said cross member wall (242) of said upper mounting plate part in which said at least one said arc-shaped shoulder (262) can be suspended.

* * * * *